United States Patent [19]

Breuer et al.

[11] 4,165,980

[45] Aug. 28, 1979

[54] METHOD OF RAPIDLY DECARBURIZING FERRO- ALLOYS WITH OXYGEN

[75] Inventors: Friedrich Breuer, Eschweiler; Karl Brotzmann, Sulzbach-Rosenberg; Günter Duderstadt, Hosel; Rudolf Fichte, Nuremberg; Fritz Stadler, Meererbusch, all of Fed. Rep. of Germany

[73] Assignee: GfE Gesellschaft fur Elektrometallurgie mit Beschrankter Haftung, Dusseldorf, Fed. Rep. of Germany

[21] Appl. No.: 527,826

[22] Filed: Nov. 27, 1974

Related U.S. Application Data

[63] Continuation of Ser. No. 316,085, Dec. 18, 1972, abandoned.

[30] Foreign Application Priority Data

Jan. 13, 1972 [DE] Fed. Rep. of Germany ..... 2201388

[51] Int. Cl.$^2$ ..... C21C 5/34

[52] U.S. Cl. ..... 75/60; 75/59

[58] Field of Search ..... 75/60, 59, 52

[56] References Cited

U.S. PATENT DOCUMENTS

| | | | |
|---|---|---|---|
| 1,363,657 | 12/1920 | Kalling | 75/60 |
| 3,240,591 | 3/1966 | Keyser | 75/52 |
| 3,706,549 | 12/1972 | Knuppel | 75/60 |
| 3,751,242 | 8/1973 | Knuppel | 75/60 |
| 3,771,998 | 11/1973 | Knuppel | 75/60 |

*Primary Examiner*—P. D. Rosenberg
*Attorney, Agent, or Firm*—Karl F. Ross

[57] ABSTRACT

The invention relates to a method of rapidly decarburizing a high-carbon ferro-alloy with oxygen for avoiding an undesirable oxidation of the principal alloying elements, especially chromium or manganese, comprising blowing an oxidizing gas under the surface of a bath of molten ferro-alloy from one or more gas-jacketed nozzles in an amount ranging between substantially 3 and 15 $m^3$ S.T.P. per metric ton of ferro-alloy with reduction of the carbon content of the ferro-alloy at a rate of about 0.2% to 1%. Comminuted solids, especially particles of oxides of alkaline-earth metals such as powdered lime, may be admixed with the oxidizing gas to prevent the ejection of molten metal from the bath.

2 Claims, No Drawings

METHOD OF RAPIDLY DECARBURIZING FERRO- ALLOYS WITH OXYGEN

This application is a continuation of our copending application Ser. No. 316,085, filed Dec. 18, 1972 and now abandoned.

This invention relates to a method of rapidly decarburizing ferro-alloys with oxygen.

Ferro-alloys are alloys which, besides iron, contain nonferrous alloying elements for making high-alloy steels, for example chromium, manganese, niobium, tantalum and vanadium, in quantities preferably exceeding 40%. The conventional refning method of reducing the carbon content of high-carbon ferro-alloys is that of fining with a kindred ore. The refining of ferrochrome is accomplished for instance with a lump ore, the carbon content being thus reduced for example from 7.5% to 2%. However, the more the carbon content of the alloy is lowered the greater is the chromium oxide content of the slag, which is then reused by recycling.

When oxygen is used for removing carbon from ferro-alloys, the process of decarburization in principle proceeds similarly by the formation of intermediate slags that are rich in oxygen. Two processes have been proposed, namely a two-stage process comprising blowing oxygen from the side of a converter followed by top-blowing oxygen on the surface of the bath, and a single-stage process of top blowing with the so-called oxygen lance.

Neither of those processes has proved fully satisfactory. Although the conventional two-stage process provides relatively low carbon contents, especially with a vacuum after-treatment as a third stage, the unavoidably long blowing times cause considerable slagging of the alloying elements which, particularly with chromium, may possibly produce between 30 and 80% of $Cr_2O_3$ in the slag. Furthermore, with top blowing, ejection of molten metal during the blow is considerable. The blowing times may be marked by a decarburization rate of about 0.1% per minute.

A technical survey on the decarburization of ferrochrome is described in the publication "Technische Mitteilung Krupp Forschungsberichto," Vol. 21/1963, No. 4, pp. 123 et seq. The article describes one of the processes hereinbefore mentioned, namely the three-stage so-called Wacker process, and the unsatisfactory results obtained therewith, and also includes an examination of the top-blowing process, which is alleged to be acceptable only if performed as a two-stage process. It is suggested to top-blow oxygen in a first stage and then continue in a second stage with aluminum to fully reduce the slag which is rich in chromium oxide. Only by proceeding in such a manner may satisfactory metal yields be achieved. Nevertheless such proposals have not been taken up in practice. For the reasons hereinbefore set forth, only oxygen top-blowing processes are in use, which lead to a partial decarburization to carbon contents of about 5%.

Methods have also been proposed in which chromium-containing steels having chromium contents of up to 30% may be decarburized by blowing oxygen on or into the metal bath. For instance, one such method specifies blowing the gas in discrete small bubbles or in a dispersion of small bubbles into the bath a few centimeters below the surface. The gas-metal reaction is stated to be more effective with smaller cross-section of the bubbles.

Recently a further method has been used in practice for the removal of carbon and of the elements silicon, phosphorus and sulphur from pig iron. In that process the oxidizing gas is bottom or side blown into the melt at high velocity through one or more gas nozzles provided with jackets through which protective fluids, for example hydrocarbons, are simultaneously blown. Provided that nitrogen has no adverse effect upon the steel alloy that is to be produced, the oxidizing gases are pure oxygen or oxygen-enriched air, or mixtures of oxygen with noble gases, e.g. argon, or steam or carbon dioxide solus or in admixture with oxygen. The advantage of this process lies in the possibility of using converters equipped for bottom blowing without any major additional apparatus for fining with oxidizing gases by blowing the gas under the bath surface. It is also possible in a new plant to reduce the height of the building and to save money by the elimination of the bulky and heavy overhead equipment needed for lowering the lances vertically from above.

The reduced slagging, moderate evolution of fumes during the blow and increased life of the converter lining are advantages which are inherent in such a process.

The processes hereinbefore described have not been considered suitable for blowing ferro-alloys since commercial ferro-alloys, e.g. ferrochrome and ferromanganese, contain substantially less iron, namely 10 to 25%, and the alloying component is in the form of stable metal carbides. By contrast, iron carbide is less stable. The application of this more recent blowing method to ferro-alloys would have been expected to produce considerable metal slagging without providing any discernible metallurgical advantage, for the reason amongst others that the evaporation temperatures of chromium and manganese are substantially lower than that of iron, which consideration alone would be expected not to result in a technically and economically acceptable process.

The object of our present invention is to provide a method of rapidly decarburizing ferro-alloys with ozidizing gases which avoids or mitigates the disadvantages hereinbefore set forth and which in particular avoids the undesirable oxidation of the principal alloying components. This object is realized, in accordance with our invention, by blowing an oxygen-containing gas at high velocity, i.e. from 3 $Nm^3$/min to 15 $Nm^3$/min per metric ton of ferro-alloy melt corresponding to a decarbonization speed of 0.2 to 1% C/min, from a conventional jacket-type gas nozzle under the surface of the bath for direct reaction with the carbon in the melt. Such nozzles, from which the oxygen stream is discharge in a protective gaseous envelope, are referred to hereinafter as gas-jacketed nozzles and are well known per se. To prevent the ejection of liqud melt, pulverulent and/or fine-grained solid particles, preferably of oxides of alkaline-earth metals such as powdered lime, are added to the oxidizing gas. If the process is carried out without the addition of solid particles, the ejection of considerable quantities of melt is to be expected with up to 10% losses.

The method according to the invention allows a melt to be blown down to specified final carbon contents. The oxidizing gas used for blowing, particularly technically pure oxygen, is blown in at high velocity at the rate of 15 cubic meters (S.T.P.) of oxygen per metric ton of charge for each 1% of carbon that is to be removed, for a period of 1 to 5 minutes for each 1% of carbon remoed. By observing these blowing conditions the carbon is rapidly oxidized in the melt. It is possible in this manner to remove more than 0.2% of carbon every minute, in contrast to hitherto used processes in which decarburization proceeds at the rate of 0.1% per minute. This may be attributed to the fact that bottom blown or side-blown oxidizing gas reacts rapidly with the carbon in the alloy melt without causing a significant oxidation of the alloying elements, particularly of the chronium and manganese. This is at variance with the decarburizing process that occurs in top blowing, wherein the oxygen reacts firstly with the alloying element, or in the case of steel with the iron, to form a slag rich in metal oxide which then reacts with the carbon in the metal melt. Moreover, in conventional top blowing a so-called "slag pumice" is generated during the first blowing stage, creating a substantially enlarged contact surface between metal and slag. In the process according to the invention the oxygen reacts directly with the carbon in the melt, and, furthermore, the side or bottom blowing of the oxidizing gas into the melt below the surface of the bath causes considerable turbulence throughout the alloy melt. This accounts for the rapidity of decarburization and for the greatly reduced oxidation of the alloying component. The step of introducing together with the oxidizing gas, fine or highly comminuted solid particles, particularly of alkaline-earth-metal oxides, is of major importance in achieving a surprisingly smooth blow and an accelerated decarburization. The fine solid particles apparently form nuclei or seeds for carbon monoxide bubbles in a manner analogous to the use in chemistry of stones to facilitate ebullition and bubble evolution in a liquid. The addition of fine or granular solid particles substantially promotes the formation of carbon monoxide in the melt and the discharge of the carbon monoxide from the melt. Solids such as a kindred fine ore or slag produce the same or similar results. However, alkaline earth oxides, particularly powdered quick-lime, are especially useful because they also have a regulating effect on the basicity of the slag, i.e. the $CaO/SiO_2$ weight % ratio, which should exceed 1.5.

The ferro-alloy blown according to the invention is preferably superheated, when fining begins, to at least 100° C. above its melting range. This temperature of superheat may be generated in the producing furnace itself or in a following special furnace, for example an induction furnace or an electric-arc furnace. Alternatively the ferro-alloy melt may be superheated in the actual blowing converter by oxidizing elements, e.g. metals or alloys having an affinity for oxygen, which either may already be present or are added, for example silicon, ferrosilicon and/or aluminum, with the calculated quantity of oxygen at the beginning of the blow. In order to bind the $SiO_2$ or $Al_2O_3$ which is thus formed, a corresponding quantity of lime is blown into the melt to form a calcium silica slag. The line, for instance in the form of lime chips, may also be introduced into the melt in another way, for instance from above. The slag which is formed by such means is preferably skimmed from the bath surface before the actual fining blow begins to avoid interfering with the subsequent decarburization reaction and to more readily enable carbon monoxide to escape during the blow.

A starting material which may be used according to the invention may be ferrochrome consisting essentially of 40 to 80% chromium
up to 9% carbon
up to 8% silicon
balance iron, together with impurities including phosphorous and sulphur.

Another starting material which may be used is a ferromanganese consisting essentially of 40 to 90% manganese
up to 8% carbon
up to 8% silicon
balance iron, together with impurities including phosphorous and sulphur.

The working temperature for ferrochrome is preferably from 1650° to 1750° C. and for ferromanganese it is preferably from 1450° to 1650° C. It is important in the processes according to the invention that such working temperatures are maintained constant. Since during the decarburization process the temperature of the alloy melt rises, cooling is necessary, which may be effected by adding to the melt suitable solid cooling materials, e.g. recycled metal of a similar (kindred) kind, such as fines from the disintegration of metal ingots, slag containing kindred metal, or a kindred ore which may be partly reduced, for instance in the form of pellets or briquettes and scrap.

The use of a high working temperature requires that immediately after the end of the blow the melt should be lowered from that working temperature to the casting temperature as quickly as possible, to avoid reducing the lift of the lining of the casting molds and to prevent the oxidation of the alloy melt due to an excessively long standing time. Such cooling can be achieved by adding cooling metal, for example recycled metal of kindred type. Alternatively cooling may be completely or partly effected by blowing the melt with inert gases, for example argon.

Another advantage of the method according to the invention over previously known methods is that it permits carbon-containing ferro-alloys having a silicon content exceeding 2% to be fined. Silicon-rich alloys, e.g. a ferrochrome containing 52% Cr, 6% Si and 6% C, can also thus be decarburized.

The volume of oxidizing gas depends mainly upon the quantity of carbon that is to be removed. For example, if a ferro-alloy containing 8% carbon is to be reduced to 4% carbon in the final alloy, then the removal of 1% of carbon requires about 15 cubic meters (S.T.P.) of oxygen per metric ton of the charge, blown in within a period of 1 to 5 minutes through one or more gas-jacketed nozzles according to the invention. The cross-section of the nozzles should be as small as possible to generate high gas velocities. With ferro-manganese, approximately the same volumes of oxidizing gas are needed per ton of initial charge as for ferrochrome.

If it is desired to produce a ferro-alloy having a low carbon content, for instance less than 0.5% carbon, then we prefer to blow pure oxygen initially and towards the end of the blow to add argon, or a mildly oxidizing gas, e.g. carbon dioxide or steam, to the oxygen. This reduces the partial pressure of the carbon monoxide and achieves a further decarburization without causing major oxidation of the alloying element.

The process according to the invention produces extremely small proportions of slag. The recovery of metal oxides contained in this slag can be dispensed with, in contrast to previously known processes where this is necessary for achieving economic efficiency.

The following Examples of the invention are illustrative of our invention:

EXAMPLE 1

Production of a ferrochrome containing 4% to 6% carbon.

In an electric-arc furnace 212 metric tons of ferrochrome containing 59.7% Cr
7.27% C
1.05% Si
0.03% S
0.05% P were superheated to 1670° C. (the melting range of such an alloy is 1400° to 1450° C.) and then oxygen was blown in a converter in consecutive batches of 5.5 tons. The converter had a magnesite refractory lining and was provided with a gas-jacketed nozzle located about 200 mm above floor level, butane being blown through the jacket as a protective medium. 200 cubic meters (S.T.P.) of oxygen were blow for 6 to 12 minutes per charge. At the beginning of each blow 260 kg of fine lime were also blown in. The temperature of the liquid melt was maintained at a constant value by the continuous introduction of a total of about 400 kg of ferrochrome fines (from 0 to 10% based on the total charge). At the end of the blow another 250 kg (about 5% based on the total converter charge) of ferrochrome fines were added to the alloy melt which was then immediately poured into a lined basin.

A total of 198 tons of ferrochrome were obtained containing 62.3% Cr
4.9% C
<0.10% Si
0.015% S
0.015% P Diregarding the fines, the chromium yield was 97.5%.

EXAMPLE 2

Production of a ferrochrome containing 1% to 2% carbon.

65 metric tons of a ferrochrome containing 59.7% Cr
7.18% C
1.49% Si
0.05% S
0.06% P were superheated, as described in Example 1, to 1700°–1750° C. and then oxygen was blown in consecutive batches of 5.5 tons. For each batch, 520 cubic meters (S.T.P.) of oxygen were blown for 15 to 25 minutes. As in Example 1, finely powdered lime was also blown in and about 20% of ferrochrome fines added to the melt.

A total of 57 tons of ferrochrome were obtained with a nonferrous content of 62.1% Cr
1.11% C
<0.10% Si
0.012% S
0.025% P the chromium yield, disregarding the fines, being 91.2%.

EXAMPLE 3

Production of a ferrochrome containing 0.5% carbon.

33 metric tons of a ferrochrome containing 59.7% Cr
7.18% C
1.89% Si
0.03% S
0.06% P were superheated as described in Example 1 to between 1700° and 1750° C. and then lown with oxygen in separate batches of 5.5 tons. For each batch, 580 cubic meters (S.T.P.) of oxygen were blown in for 20 to 30 minutes. Again as in Example 1, 350 kg of finely powdered lime were also blown in and about 20% of ferrochrome fines were introduced into the melt.

A total of 28.5 tons of ferrochrome were obtained with a nonferrous content of 62.5% Cr
0.48% C
<0.10% Si
0.01% S
0.025% P the chromium yield, disregarding the fines, being 90.4%.

EXAMPLE 4

Production of a ferromanganese containing 1 to 2% carbon.

35 metric tons of a ferromanganese containing 75.7% Mn
6.7% C
0.85% Si
0.03% S
0.20% P were superheated, as described in Example 1, to between 1470° and 1500° C. (the melting range of such an alloy being from 1060 to 1220° C.) and blown with oxygen in 5.5-ton batches. In each batch, about 500 cubic meters (S.T.P.) of oxygen were blown in 15 to 25 minutes. As in Example 1, 150 kg of finely powdered lime were also blown in; during the blow 500 kg of ferromanganese fines, and after the blow another 259 kg of ferromanganese fines, were introduced into the melt. A total of 30 tons of ferromanganese were obtained with a nonferrous content of 74.7% Mn
1.3% C
<0.10% Si
0.01% S
0.10% P the manganese yield, disregarding the fines, being 83.9%.

What is claimed is:

1. A method of refining a high-carbon ferro-alloy rich in manganese, comprising the steps of:
   - melting a ferro-alloy to form a bath, said ferro-alloy consisting essentially of 30–90% manganese, up to 8% carbon, up to 8% silicon, balance iron and nonmetallic impurities;
   - heating said bath to a temperature at least 100° C. above the melting point of said ferro-alloy; and
   - blowing an oxidizing gas enveloped by a protective gas into the melt below the surface of said bath, in an amount ranging between substantially 3 and 15 cubic meters S.T.P. of oxygen per minute for each metric ton of ferro-alloy, for a period sufficient to oxidize significant quantities of carbon in the melt at a rate of substantially 0.2% to 1% carbon per minute.

2. A method as defined in claim 1 wherein the bath temperature does not exceed substantially 1650° C.

* * * * *